US006212836B1

(12) United States Patent
Larson

(10) Patent No.: US 6,212,836 B1
(45) Date of Patent: Apr. 10, 2001

(54) SELF-ALIGNING DRYWALL CORNER BEAD

(75) Inventor: John A. Larson, Parkland, FL (US)

(73) Assignee: Plastics Components, Inc., Miami, FL (US)

( * ) Notice: Subject to any disclaimer, the term of this patent is extended or adjusted under 35 U.S.C. 154(b) by 0 days.

(21) Appl. No.: 09/314,831

(22) Filed: May 19, 1999

(51) Int. Cl.[7] ..... E04F 13/06; E04F 19/02

(52) U.S. Cl. ..... 52/287.1; 52/255; 52/288.1; 52/417; 52/717.03; 52/713.05

(58) Field of Search ..... 52/287.1, 288.1, 52/717.03, 717.05, 255, 417

(56) References Cited

U.S. PATENT DOCUMENTS

| | | | | |
|---|---|---|---|---|
| Re. 345,547 | | 2/1994 | Weldy . | |
| 4,843,771 | * | 7/1989 | Chapman et al. | 52/288 |
| 4,863,774 | | 9/1989 | Tucker . | |
| 5,086,598 | * | 2/1992 | Weldy | 52/288 |
| 5,131,198 | | 7/1992 | Ritchie . | |
| 5,544,463 | * | 8/1996 | Bergin | 52/254 |
| 5,740,642 | * | 4/1998 | Koenig, Jr. et al. | 52/255 |
| 5,752,353 | | 5/1998 | Koenig et al. . | |
| 5,778,617 | | 7/1998 | Frec . | |
| 5,813,179 | * | 9/1998 | Koenig, Jr. et al. | 52/255 |
| 5,913,335 | | 3/1997 | Rennich et al. . | |
| 6,044,601 | * | 4/2000 | Chmela | 52/287.1 |

* cited by examiner

*Primary Examiner*—Carl D. Friedman
*Assistant Examiner*—Yvonne M. Horton

(57) ABSTRACT

A corner bead comprising an arcuately profiled elongated central portion having two lateral edges and defining a concave and a convex surface, flanges extending from each of the lateral edges and unitarily formed therewith. The concave surface includes a pair of longitudinal rails extending at about 90° one from the other at the geometrical centerline of the concave surface and serve to align the corner bead of the present invention with the underlying drywall when applied over a drywall corner in the conventional fashion.

9 Claims, 2 Drawing Sheets

SELF-ALIGNING DRYWALL CORNER BEAD

FIELD OF THE INVENTION

The present invention relates to corner beads for drywall corner installation and more specifically to such a product that is self-aligning in installation.

BACKGROUND OF THE INVENTION

Typically, a corner bead for trimming a drywall corner has a central portion with two lateral edges and two flange portions, each extending from one of the lateral edges of the central portion.

It is also known to provide the flange portions with an array of apertures, either circular apertures or elongated slots, whereby the "mud", when pressed onto the outer surface of the flange portions, can be thus pressed through the apertures or holes and into intimate contact with the underlying drywall. When pressed through the apertures such material or "mud" bonds with and helps to attach the corner bead to the underlying drywall.

Commonly, the central portion has an arcuate profile and defines a convex surface and a concave surface, whereupon the convex surface becomes the outer surface in use. If the convex surface has a large radius, for example within the range of from about 0.375 to about 1.5 inches, it is commonly known as a "bullnose" corner bead.

Weldy, U.S. Pat. No. Re. 34,547 discloses various corner beads, two-way and three-way corners having central portions with an arcuate profile and having two flange portions.

Koenig et al, U.S. Pat. No. 5,752,353 describes a drywall trimming article having an arcuately profiled, elongated central portion and two flange portions that are extruded unitarily. Each flange has a series or array of apertures as described above. In the case of Koenig et al, the outer surface of the corner bead is coated with a fibrous material to promote adhesion of the subsequently applied "mud".

In installation, the corner bead is typically stapled or glued to the drywall corner prior to application of the dry wall finishing material or "mud" to maintain the positioning of the corner bead during "mud" application. The gluing or stapling can be a time consuming process in an otherwise rapid application process Additionally, most drywall corners are not perfectly square. Consequently, alignment of the corner bead with the underlying drywall corner can be difficult. Furthermore, failure to so attach the corner bead to the corner prior to "mud" application can result in slippage or movement of the corner bead from its proper location during such installation.

The simplification of the corner bead alignment with the underling drywall corner is often accomplished through the use of relatively complex and/or relatively expensive power tools that assist with alignment while stapling or gluing the corner bead to the underlying drywall The elimination of the use of such tools or the stapling or gluing operation entirely, would be of great value to the drywall installer in terms of time and cost. The mere ability to rapidly achieve corner bead alignment with the underlying drywall corner is of great value for the same reasons, even if stapling or attachment is still performed.

OBJECT OF THE INVENTION

It therefore an object of the present invention to provide a drywall corner bead that can be easily and accurately aligned with the underlying drywall corner and does not require fastening of the corner bead to the drywall prior to application of the "mud" to avoid movement thereof during "mud" application.

SUMMARY OF THE INVENTION

According to the present invention, there is provided an improved corner bead comprising an arcuately profiled, elongated central portion having two lateral edges and defining a concave and a convex surface, flanges extending from each of the lateral edges and unitarily formed therewith. The concave surface includes a pair of longitudinal rails extending at about 90° one from the other and along the geometrical centerline of concave surface 26, that serve to align the corner bead of the present invention with the underlying drywall, without the need for stapling, gluing or otherwise attaching the corner bead to the drywall to prevent relative movement thereof prior to application of the "mud". Stapling, gluing etc. may, of course, still be used, if desired.

DETAILED DESCRIPTION

Figure 1:
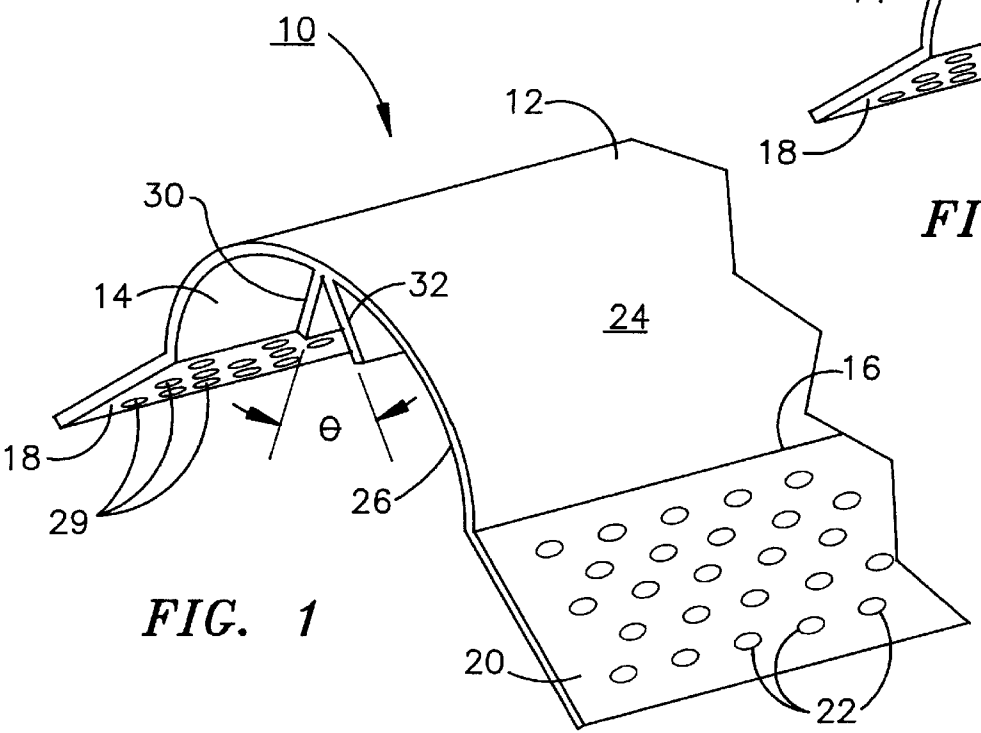
FIG. 1 is a perspective view of one embodiment of the drywall corner bead of the present invention.

As shown in FIG. 1, the corner bead 10 of the present invention comprises an elongated central portion 12 having two lateral edges 14 and 16. Central portion 12 has an arcuate shape. Extending laterally from edges 14 and 16 are flanges 18 and 20. According to a preferred embodiment, flanges 18 and 20 have apertures 22 therein to permit penetration of "mud" as described hereinabove. Central portion 12 has an outer convex surface 24 and a concave inner surface 26. Extending from convex inner surface 26 is a pair of longitudinal rails 28.

In the embodiment depicted in FIG. 1, longitudinal rails 28 are in the form of a "V" whose individual lees 30 and 32 extend at substantially right angles to each other, i.e. the angle θ is about 90°. The base of the "V" in this embodiment is along the geometrical center of concave surface 26. With this configuration, when corner bead 10 is applied to a drywall corner and rails 30 and 32 applied on opposing surfaces of the corner, corner bead 10 is self-aligning with the corner of the drywall, and no stapling or other fastening of corner bead 10 is required to hold corner bead 10 in the aligned position during application of the "mud". Stapling may, or course, be used, if desired, but corner bead 10 will be self-aligning during the stapling operation. The length of rails 30 and 32 is not particularly critical to the successful practice of the invention so long as they are long enough to properly contact the underlying drywall corner, but not so long as to interfere with proper application. Lengths on the order of about ¼ to about ¾ inch have been found satisfactory.

Figure 2:
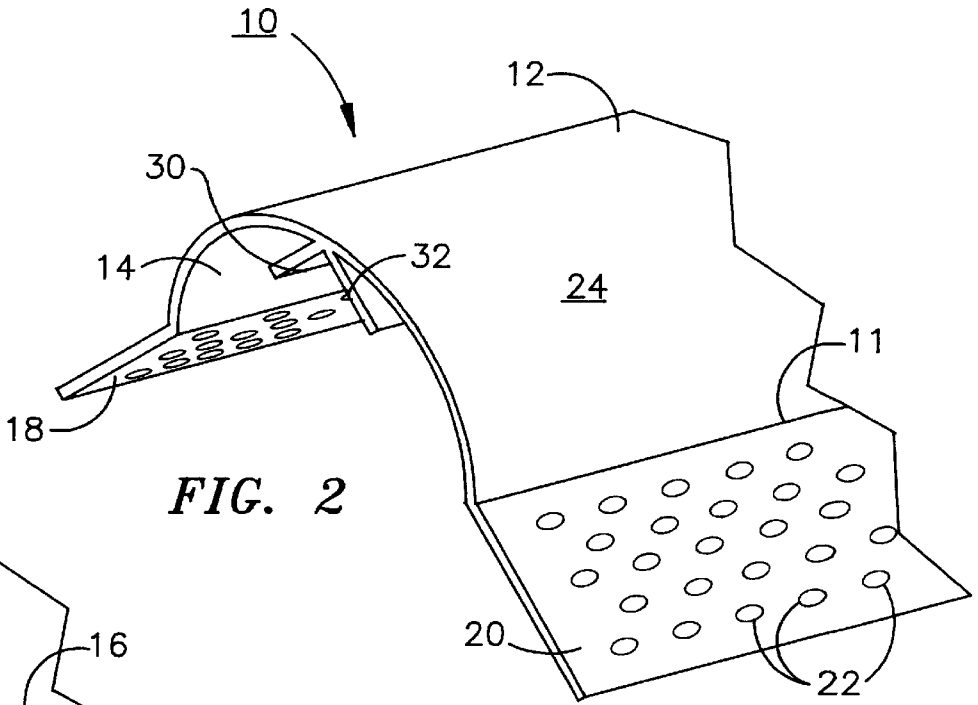
FIG. 2 is a perspective view of a second embodiment of the drywall corner bead of the present invention.

A second preferred embodiment of the corner bead 10 of the present invention is depicted in FIG. 2. In this case, all of the elements are essentially the same, i.e. corner bead 10 comprises an arcuately shaped, elongated central portion 12 having an outer convex surface 24, an inner concave surface 26 and lateral edges 14 and 16 and includes flanges 18 and 20 extending from edges 14 and 16. Flanges 18 and 20 preferably include apertures 22. The only distinction between the embodiment of FIG. 1 and that of FIG. 2 being that, rails 30 and 32 instead of being in the shape of a "V" whose bases intersect, their bases are spaced apart. The angle θ between rails 30 and 32, however, remains at about 90° so that when corner bead 10 is installed over an underlying drywall corner, rails 30 and 32 engage the opposing surfaces of thereof thereby centering or aligning corner bead 10 on the underlying drywall corner. Again, the midpoint between separated rails 30 and 32 is longitudinally along the geometric centerline of concave surface 26.

Figure 3:
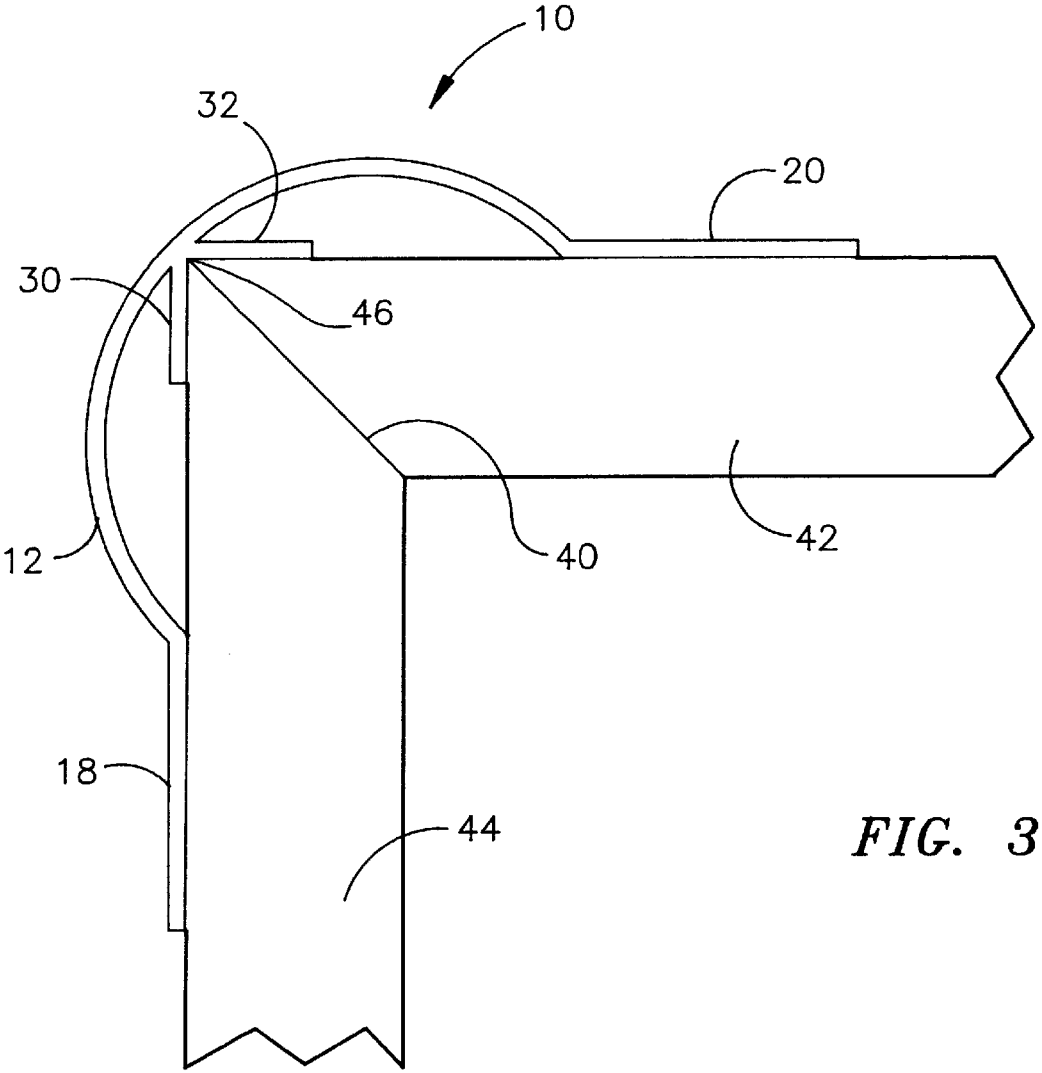
FIG. 3 is a top cross-sectional view showing the drywall corner bead of the present invention installed on a drywall corner.

FIG. 3 shows the corner bead of FIG. 1 installed over a drywall corner. As shown in FIG. 3, corner bead 10 is applied over the joint 40 formed by the intersection of drywall sheets 42 and 44. Flanges 18 and 20 form contact with drywall sheets 42 and 44 while tabs 30 and 32 are in intimate contact with the approximately 90° outer corner 46 of joint 40 and align corner bead 10 with outer corner 46. In this position, corner bead 10 is perfectly aligned with outer corner 46 and no lateral movement of corner bead 10 about or laterally relative to corner 46 is possible.

While the improved corner bead of the present invention can be fabricated from any number of materials, it is preferred that it be extruded or otherwise formed from a plastic or polymeric material such as PVC (polyvinyl chloride) for reasons of cost and ease of fabrication. Such a process simplifies considerably the integration of rails 30 and 32 into the overall structure as a unitary structure.

There has thus been described an improved drywall corner bead that is self-aligning when installed over an underlying drywall corner and will not move during the subsequent application of "mud" thereover.

As the invention has been described, it will be apparent to those skilled in the art that the same may be varied in many ways without departing from the spirit and scope thereof any and an such modifications are intended to be included within the scope of the appended claims.

What is claimed is:

1. In a drywall corner bead for covering an underlying drywall corner joint comprising:

a) an arcuately profiled elongated central portion having two lateral edges and defining a concave inner surface and a convex outer surface; and b) flanges extending from each of said lateral edges and unitarily formed with said central portion;

the improvement comprising the incorporation on said concave surface of a pair of unitarily formed longitudinal rails extending from the geometrical centerline of said concave inner surface at an angle of about 90° one from the other thereby permitting engagement of said rails with said underlying drywall corner joint when said corner bead is applied over said drywall corner joint.

2. The corner bead of claim 1 wherein said pair of unitarily formed longitudinal rails form the shape of a V.

3. The corner bead of claim 1 wherein said pair of unitarily formed longitudinal rails each has a base and said bases are separated.

4. The corner bead of claim 1 further including apertures in said flanges.

5. The corner bead of claim 2 further including apertures in said flanges.

6. The corner bead of claim 3 further including apertures in said flanges.

7. The corner bead of claim 1 produced by the extrusion of a polymeric material.

8. The corner bead of claim 7 wherein said polymeric material is polyvinyl chloride.

9. The corner bead of claim 1 wherein said rails are from about ¼ to about ¾ inches in height.

* * * * *